US006904844B2

(12) United States Patent
Koizumi et al.

(10) Patent No.: US 6,904,844 B2
(45) Date of Patent: Jun. 14, 2005

(54) PRINTING PLATE REMOVING/SUPPLYING DEVICE

(75) Inventors: Takashi Koizumi, Kanagawa (JP); Yoshinori Kawamura, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/807,347

(22) Filed: Mar. 24, 2004

(65) Prior Publication Data

US 2004/0187723 A1 Sep. 30, 2004

(30) Foreign Application Priority Data

Mar. 25, 2003 (JP) ..... 2003-083392

(51) Int. Cl.[7] ..... B65H 3/44; B65H 5/08; B41L 47/14

(52) U.S. Cl. ..... 101/477; 271/9.08; 271/11; 271/164

(58) Field of Search ..... 101/477, 401.1, 101/479, 480; 271/9.05, 9.08, 9.11, 11, 104, 105, 106, 107, 162, 164; 414/796.4, 797, 773

(56) References Cited

U.S. PATENT DOCUMENTS 5,201,506 A * 4/1993 Kushima et al. ..... 271/5
6,341,932 B1 1/2002 Otsuji
6,520,692 B2 * 2/2003 Koizumi et al. ..... 396/518
6,739,261 B2 * 5/2004 Ono ..... 101/477

FOREIGN PATENT DOCUMENTS

JP 2000-351460 A 12/2000

* cited by examiner

*Primary Examiner*—Leslie J. Evanisko
(74) *Attorney, Agent, or Firm*—Sughrue Mion, PLLC

(57) ABSTRACT

In a removing/conveying portion of a printing plate removing/supplying device, when one cassette among a plurality of cassettes is empty, the empty cassette is placed on a raising/lowering stand and moved to a loading space. Due to a spur gear being rotated clockwise by a motor, a sliding cover, with which the spur gear is engaging, is moved toward a removing portion such that an opening of a cassette stocker portion is opened. In this way, it is possible to refill and load printing plates from a top side of the cassette stocker portion into the empty cassette positioned at the loading space.

20 Claims, 4 Drawing Sheets

PRINTING PLATE REMOVING/SUPPLYING DEVICE

CROSS-REFERENCE TO RELATED APPLICATION

This application claims priority under 35 USC 119 from Japanese Patent Application No. 2003-83392, the disclosure of which is incorporated by reference herein.

BACKGROUND OF THE INVENTION

1. Field of the Invention

The present invention relates to a printing plate removing/supplying device which removes a predetermined printing plate from plural cassettes in which printing plates are respectively accommodated, and conveys and supplies the predetermined printing plate to a section-to-be-supplied-to, which is a subsequent process.

2. Description of the Related Art

A technique in which, by using a printing plate (e.g., a PS plate, a thermal plate, a photopolymer plate) in which a recording layer (photosensitive layer) is provided on a support, an image is recorded directly by a laser beam or the like onto the photosensitive layer of the printing plate, has come to be developed as a printing plate exposing device. With this technique, it is possible to quickly record an image onto a printing plate.

In an automatic printing plate exposing device using the technique of recording images on printing plates, printing plates are removed one-by-one from a cassette in which a plurality of the printing plates are stacked, and are fed in to an exposure section.

Printing plates are classified into plural types in accordance with their size, photosensitizing method, material, and the like. Generally, a single type of printing plate is accommodated in any given cassette. In a state in which plural cassettes are stacked one above another in plural levels, the cassettes are accommodated within a cassette stocker portion (accommodating portion) and are supported on rails which are fixed to the inner walls of the cassette stocker portion. Refer to, for example, Japanese Patent Application Laid-Open (JP-A) No. 2000-351460.

At the time of refilling and loading in printing plates, side surface covers of the cassette stocker portion are opened to the left and the right, a cassette is pulled out horizontally along the rails of the cassette stocker portion and rails fixed to the side surface covers, and printing plates are loaded into the cassette.

Therefore, when setting the automatic printing plate exposing device, it is necessary to ensure space for the pulling-out of the cassettes (space for opening and closing the side surface covers). A problem arises in that ultimately a large space for placement of the device is needed. For example, in a case in which the size of the largest printing plate is 1160 mm by 940 mm, the space needed for pulling out the cassette is about 1300 mm by 1100 mm.

Further, the cassette which is pulled out to the exterior of the cassette stocker portion is supported on rails which are fixed to the side surface covers. However, the printing plates are heavy. For example, the total weight of 100 of the largest printing plates is 100 kg. The rigidity of the side surface covers and the members supporting the side surface covers (hinges or the like) must be made to be high, which results in the cost of the device increasing.

In addition, because the cassettes are accommodated in plural levels in a state in which one is disposed above another, when the device is set such that the height which makes the printing plate loading work easy is the height of the uppermost cassette, a problem arises in that the workability at the time of loading printing plates into the lower cassettes is poor.

SUMMARY OF THE INVENTION

In view of the aforementioned, an object of the present invention is to provide a printing plate removing/supplying device which results in less space needed for placement of the device, a lowering of the costs of the device, and improved workability at the time of loading printing plates.

In order to achieve the above object, a printing plate removing/supplying device relating to a first aspect of the present invention has an accommodating portion, a cover member, a removing portion, a cassette moving mechanism, and a removing/conveying mechanism. There is a loading space in the accommodating portion. An opening is formed at the top end of the loading space. Cassettes are accommodated so as to be stacked one above the other in plural levels in a state of being provided at predetermined intervals. Plural printing plates are loaded and stacked in the cassettes from the upper side thereof. One cassette can be accommodated directly beneath the opening. At the accommodating portion, the printing plates can be loaded from the opening into the cassette which is positioned at the loading space. The cover member is provided at the opening of the accommodating portion, and can open and close the opening. The removing portion is provided adjacent to the accommodating portion. A printing plate removing position is set at the removing portion. The cassette moving mechanism is provided at the removing portion, and, independently of other cassettes, pulls one cassette selected from among the plurality of cassettes out to the removing portion and moves the selected one cassette to the removing position, and is able to move the selected one cassette to the loading space as well. The removing/conveying mechanism is provided at the removing portion, and removes the printing plate from the cassette positioned at the removing position, and conveys and supplies the printing plate to a portion-to-be-supplied-to of a subsequent process.

In this printing plate removing/supplying device, the printing plates are accommodated in stacked states in the cassettes, which are disposed one above the other in plural levels in the accommodating portion. One selected cassette among the plurality of cassettes is, by the cassette moving mechanism, pulled-out to the removing portion and moved to the removing position. By the removing/conveying mechanism, a printing plate is removed and is conveyed and supplied to a portion-to-be-supplied-to of the subsequent process.

Here, when one of the cassettes among the plural cassettes is empty, i.e., when there is the need to refill printing plates, the empty cassette is moved by the cassette moving mechanism to the loading space of the accommodating portion. Then, due to the cover member, which is provided at the opening of the accommodating portion, being moved, the upper end of the accommodating portion is opened, and the empty cassette, which has been moved to the loading space, is exposed. In this way, printing plates can be loaded (refilled) from above the accommodating portion into the cassette positioned at the loading space.

Accordingly, as compared with a case in which a cassette is pulled out horizontally from the accommodating portion and the printing plates are loaded therein, it is not necessary to ensure space for pulling-out of the cassette. Therefore, the space required for placement of the device can be reduced.

Moreover, there is no need for members (side surface covers, members for supporting the side surface covers, and the like) for supporting the cassette in the state in which the cassette is pulled out. Therefore, the cost of the accommodating portion can be reduced.

In addition, because the printing plates can be loaded into the plural cassettes at the same operational posture (at the same position), the workability at the time of loading the printing plates is improved.

When the operation for loading the printing plates into the cassette is completed, the opening of the accommodating portion is closed by the cover member. Then, the cassette is again moved (i.e., is returned) to the predetermined position by the cassette moving mechanism.

In this way, in the printing plate removing/supplying device of the first aspect, it is possible to reduce the space required for placement of the device, reduce the cost of the device, and improve the workability at the time of loading the printing plates.

In the printing plate removing/supplying device, the cover member may be structured so as to move to open and close the opening, within a range of an interior of the accommodating portion and an interior of the removing portion.

In this case, the cover member is moved to open and close the opening within the range of the interior of the accommodating portion and the interior of the removing portion. Namely, in the state in which the cover member has been moved and the opening of the accommodating portion is opened, the cover member is accommodated within the range of the interior of the accommodating portion and the interior of the removing portion.

In this way, the cover member does not project out beyond the space in which the printing plate removing/supplying device is placed. Therefore, less space is required.

DETAILED DESCRIPTION OF THE INVENTION

Figure 1:
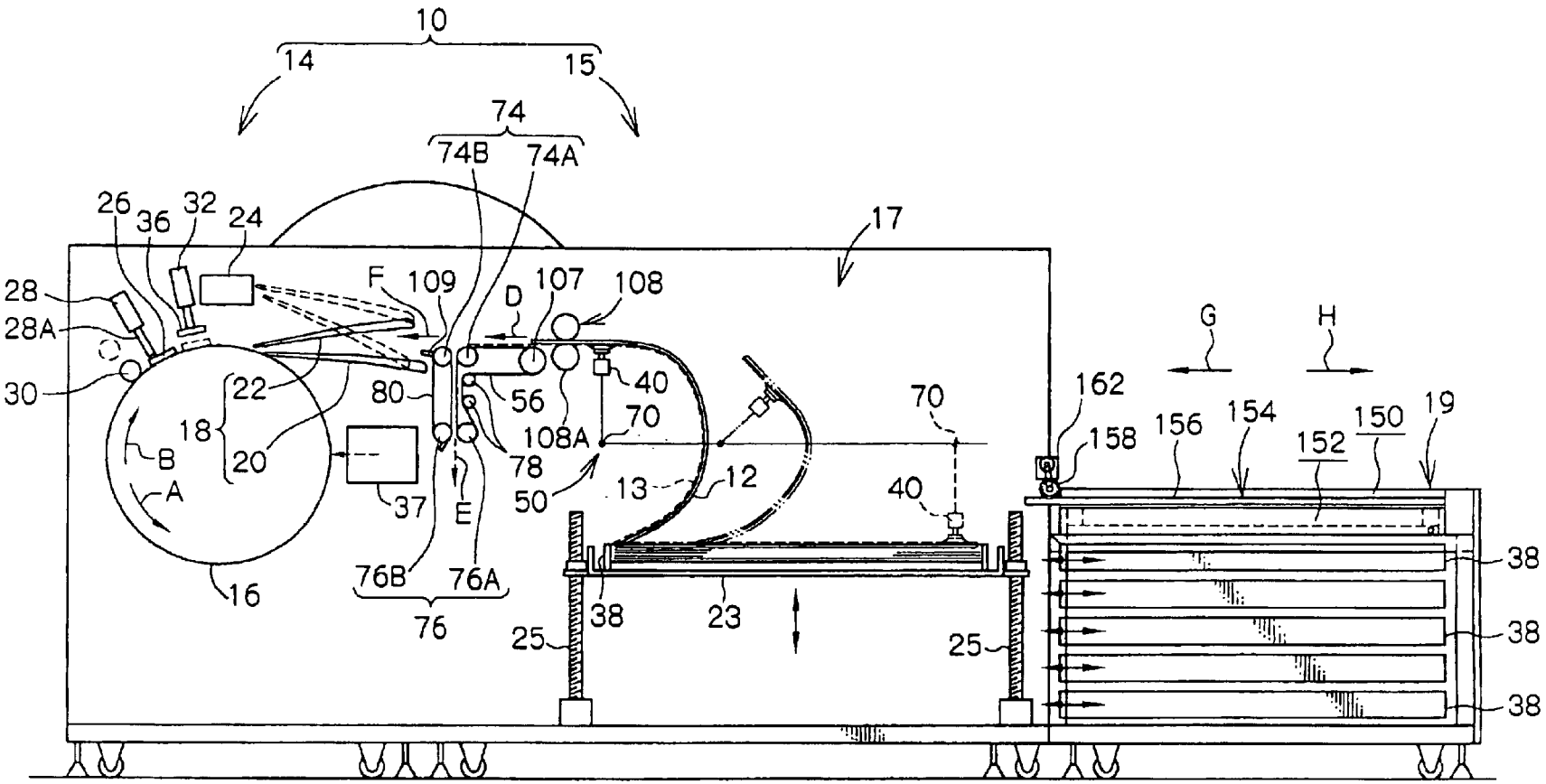
FIG. 1 is a schematic side view showing the overall structure of an automatic printing plate exposing device to which is applied a printing plate removing/supplying device relating to a first embodiment of the present invention.

The schematic overall structure of an automatic printing plate exposing device 10, to which a sheet sucking/feeding device 50 relating to a first embodiment of the present invention is applied, is shown in FIG. 1.

The automatic printing plate exposing device 10 is divided into two main sections which are an exposure section 14, which illuminates a light beam onto an image forming layer of a printing plate 12 so as to expose an image, and a sheet feeding/conveying section 15 which removes the printing plate 12 and conveys the printing plate 12 to the exposure section 14. The printing plate 12, which has been subjected to exposure processing by the automatic printing plate exposure device 10, is fed out to a developing device (not illustrated) which is disposed adjacent to the automatic printing plate exposure device 10.

Structure of Exposure Section

The exposure section 14 is structured such that a rotating drum 16, around whose peripheral surface the printing plate 12 is trained and held, is the main portion of the exposure section 14. The printing plate 12 is guided by a conveying guide unit 18, and is fed in from a direction tangent to the rotating drum 16. The conveying guide unit 18 is structured by a plate supplying guide 20 and a plate discharging guide 22. Conveying rollers 108 and a guide plate 109 are disposed at the side of the conveying guide unit 18 which side borders on the sheet feeding/conveying section 15.

The relative positional relationship of the plate supplying guide 20 and the plate discharging guide 22 of the conveying guide unit 18 is such that the plate supplying guide 20 and the plate discharging guide 22 form a sideways V shape. The plate supplying guide 20 and the plate discharging guide 22 rotate by predetermined angles around the right end portion sides thereof in FIG. 1. Due to this rotation, the plate supplying guide 20 can be selectively disposed at a position corresponding to the rotating drum 16 (a position of being disposed in a direction tangent to the rotating drum 16), and a position of inserting the printing plate 12 into a puncher 24 which is provided above the rotating drum 16. The printing plate 12 which has been fed in from the sheet feeding/conveying section 15 is first guided by the plate supplying guide 20 and fed into the puncher 24 where notches for positioning are formed in the leading end of the printing plate 12. Further, after the printing plate 12 undergoes processing at the puncher 24 as needed, the printing plate 12 is returned to the plate supplying guide 20. The printing plate 12 is thereby moved to a position corresponding to the rotating drum 16.

The rotating drum 16 is rotated by an unillustrated driving means in a direction in which the printing plate 12 is attached and exposed (the direction of arrow A in FIG. 1), and in a direction in which the printing plate 12 is removed (the direction of arrow B in FIG. 1) which is opposite to the attaching/exposing direction.

Leading end chucks 26 are mounted to predetermined positions of the outer peripheral surface of the rotating drum 16. At the exposure section 14, when the printing plate 12 is to be attached to the rotating drum 16, first, the rotating drum 16 is stopped at a position (printing plate attaching position) at which the leading end chucks 26 oppose the leading end of the printing plate 12 which has been fed in by the plate supplying guide 20 of the conveying guide unit 18.

An attaching unit 28 is provided in the exposure section 14 so as to oppose the leading end chucks 26 at the printing plate attaching position. Due to extending/retracting rods 28A of the attaching unit 28 extending and one end sides of the leading end chucks 26 being pressed, the printing plate 12 can be inserted between the leading end chucks 26 and the peripheral surface of the rotating drum 16. In the state in which the leading end of the printing plate 12 is inserted between the leading end chucks 26 and the rotating drum 16, the extending/retracting rods 28A of the attaching unit 28 are pulled back such that their pressing of the leading end chucks 26 is released. In this way, the leading end of the printing plate 12 is nipped and held between the leading end chucks 26 and the peripheral surface of the rotating drum 16. At this time, the printing plate 12 is positioned due to the leading end thereof abutting positioning pins (not shown) provided on the rotating drum 16. When the leading end of the printing plate 12 is fixed to the rotating drum 16, the rotating drum 16 is rotated in the attaching/exposing direction. In this way, the printing plate 12, which has been fed in from the plate supplying guide 20 of the conveying guide unit 18, is trained about the peripheral surface of the rotating drum 16.

A squeeze roller 30 is provided at the downstream side, in the attaching/exposing direction (the direction of arrow A in FIG. 1), of the printing plate attaching position, in a vicinity of the peripheral surface of the rotating drum 16. Due to the squeeze roller 30 moving toward the rotating drum 16, the printing plate 12 which is trained on the rotating drum 16 is pushed toward the rotating drum 16 and is made to fit tightly to the peripheral surface of the rotating drum 16.

Further, a trailing end chuck attaching/detaching unit 32 is disposed in the exposure section 14 in a vicinity of the upstream side of the leading end chucks 26 in the attaching/exposing direction of the rotating drum 16. At the trailing end chuck attaching/detaching unit 32, trailing end chucks 36 move along guides which project out toward the rotating drum 16. When the trailing end of the printing plate 12 which is trained on the rotating drum 16 opposes the trailing end chuck attaching/detaching unit 32, the trailing end chucks 36 are moved toward the rotating drum 16 and attached to predetermined positions of the rotating drum 16. In this way, the trailing end of the printing plate 12 is nipped and held between the trailing end chucks 36 and the rotating drum 16.

When the leading end and the trailing end of the printing plate 12 are held at the rotating drum 16, the squeeze roller 30 is moved away (refer to the chain line in FIG. 1). Thereafter, in the exposure section 14, while rotating the rotating drum 16 at high speed at a predetermined rotational speed, a light beam, which is modulated on the basis of image data, is irradiated from a recording head portion 37 synchronously with the rotation of the rotating drum 16. In this way, the printing plate 12 is scan-exposed on the basis of the image data.

When the scan-exposure of the printing plate 12 has been completed, the rotating drum 16 is temporarily stopped at a position at which the trailing end chucks 36, which are holding the trailing end of the printing plate 12, oppose the trailing end chuck attaching/detaching unit 32. The trailing end chuck attaching/detaching unit 32 removes the trailing end chucks 36 from the rotating drum 16. In this way, the trailing end of the printing plate 12 is freed. Thereafter, by rotating the rotating drum 16 in the direction of removing the printing plate 12, the printing plate 12 is expelled, from the trailing end side thereof, to the plate discharging guide 22 of the conveying guide unit 18 along a direction tangent to the rotating drum 16. Thereafter, the printing plate 12 is conveyed to the developing device which is the subsequent process.

Structure of Removing/Conveying Section 15 (Printing Plate Removing/Supplying Device)

As shown in FIG. 1, the removing/conveying section 15 is structured by a removing portion 17, and a cassette stocker portion 19 serving as an accommodating portion and provided adjacent to the removing portion 17.

A raising/lowering stand 23 structuring a cassette moving mechanism is provided at the removing portion 17. The raising/lowering stand 23 is supported by feed screws 25 which also structure the cassette moving mechanism. The raising/lowering stand 23 can be raised or lowered by operation of the feed screws 25. In this way, the raising/lowering stand 23 can move upward and downward to positions corresponding to respective cassettes 38 of the cassette stocker portion 19 which will be described in detail later. The cassette 38, which is pulled out horizontally from the cassette stocker portion 19 to the removing portion 17 can be received by the raising/lowering stand 23 and placed on the raising/lowering stand 23.

A "removing position (fixed position in the vertical direction)" of the printing plate 12 by a removing/conveying mechanism 50 which will be described later is set at the removing portion 17 (the position shown in FIG. 1). The cassette 38 which is placed on the raising/lowering stand 23 can be positioned at this "removing position" due to the upward movement of the raising/lowering stand 23.

The removing/conveying mechanism 50 is provided at the removing portion 17. At the removing/conveying section 50, a plurality of (e.g., nine) suction cups 40 are disposed at predetermined pitch intervals along the transverse direction of the printing plate 12. Each of the suction cups 40 is supported so as to hang downward from a base point 70. The base points 70 can move substantially horizontally in the left/right direction in FIG. 1 along the cassette 38 which is on the raising/lowering stand 23. Moreover, the base points 70 are rotatable. In this way, after the suction cups 40 suck the printing plate 12, they rotate 180° while moving horizontally, so as to convey the printing plate 12 while inverting the printing plate 12.

At the removing/conveying mechanism 50, the suction cups 40 can move to the aforementioned "removing position" which is set at the removing portion 17. Accordingly, in the state in which the cassette 38 placed on the raising/lowering stand 23 is positioned at the "removing position", due to the respective suction cups 40 reaching the "removing position", the suction cups 40 can suck and remove the printing plate 12 from the cassette 38.

Here, when the printing plate 12 is to be taken out from the cassette 38 by the removing/conveying mechanism 50, the suction cups 40 contact the interleaf sheet 13 which is the uppermost material within the cassette 38, because the interleaf sheets 13 and the printing plates 12 (whose emulsion surfaces are facing downward) are stacked alternately within the cassette 38. When suction force is imparted to the suction cups 40 at the point in time when they contact the uppermost interleaf sheet 13, the suction force is applied to the uppermost interleaf sheet 13, as well as to the printing plate 12 therebeneath. The interleaf sheet 13 and the printing plate 12 are thereby sucked as a pair or a set together at the same time.

After this sucking, the raising/lowering stand 23, i.e., the cassette 38, is lowered and withdrawn to a predetermined withdrawn position. In this way, the sucked interleaf sheet 13 and printing plate 12 are "separated (disjoined)" by a separating plate (not illustrated) provided at the cassette 38, from the interleaf sheets 13 and printing plates 12 which are beneath and other than that sucked interleaf sheet 13 and printing plate 12. After this separation, the suction cups 40 are inverted and convey the printing plate 12 while moving horizontally. When the suction cups 40 have rotated 180°, in the state shown in FIG. 1, the interleaf sheet 13 is at the lower side and the printing plate 12 is at the upper side, and the interleaf sheet 13 and the printing plate 12 are transferred over to conveying rollers 108.

A belt 56 is trained around a roller 107 which is adjacent to a lower roller 108A of the conveying rollers 108. The belt 56 is also trained around a right roller 74A of a pair of rollers 74 which are disposed in a vicinity of the conveying guide unit 18 of the exposure section 14. A pair of rollers 76 are provided beneath the pair of rollers 74. The belt 56 is trained around a right roller 76A of the lower rollers 76, and along a pair of small rollers 78. The belt 56 forms a substantially L-shaped loop on the whole, and is driven in the direction of arrow D in FIG. 1.

A belt 80 spans between a left roller 74B of the upper pair of rollers 74 and a left roller 76B of the lower pair of rollers 76.

The roller 74B is a roller which rotates in the direction opposite to the conveying direction. The frictional force between the roller 74B and the interleaf sheet 13 is great. At times of usual conveying, the roller 74B is withdrawn beneath the plane of conveying. After the printing plate 12 and the interleaf sheet 13 have passed over the roller 74B, the roller 74B is raised, and pulls the interleaf sheet 13 in between the rollers 74 due to frictional force, and then the roller 74B is withdrawn. The interleaf sheet 13 is fed to the lower pair of rollers 76, and is discarded (refer to the chain-line arrow E in FIG. 1).

The printing plate 12 passes through above the upper pair of rollers 74, and is fed to the plate supplying guide 20 (refer to the solid line arrow F in FIG. 1).

Figure 2:
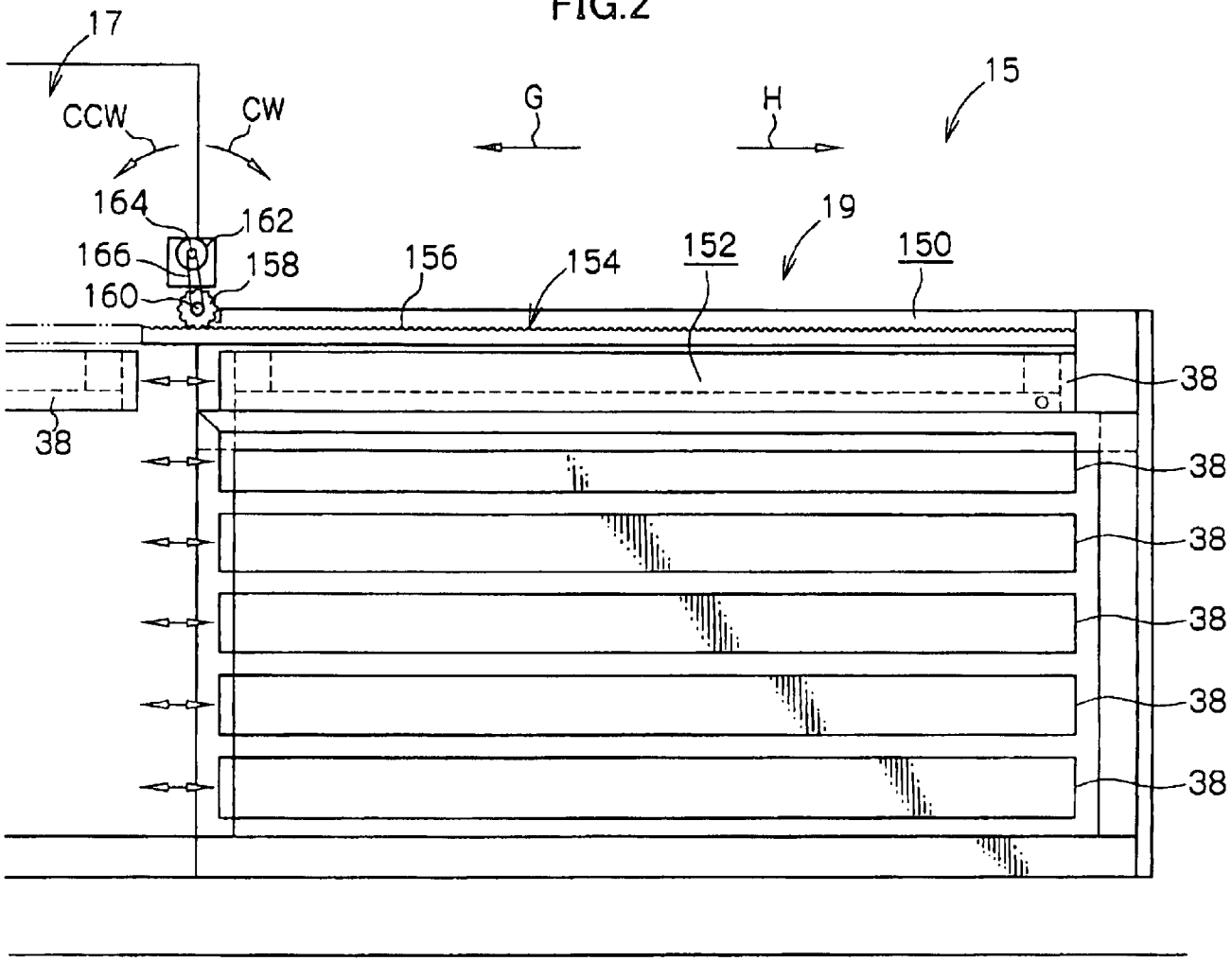
FIG. 2 is a side view showing a cassette stocker portion which is a structural member of the printing plate removing/supplying device relating to the first embodiment of the present invention.

As shown in FIG. 2, in the cassette stocker portion 19, the plurality of cassettes 38 are accommodated so as to be stacked one above the other in plural levels (five levels in the present embodiment) in the vertical direction at predetermined intervals. The cassettes 38 can be pulled-out horizontally toward the removing portion 17 along unillustrated rails. A plurality of the printing plates 12 are accommodated in the cassettes 38. The printing plate 12 is structured such that a photosensitive layer (an image recording layer) is formed on a support. The interleaf sheets 13, which serve as protective sheets for protecting the photosensitive layers of the printing plates, and the printing plates 12, whose photosensitive layers are facing downward, are accommodated within the cassette 38 in a state of being stacked alternately.

The size of the cassette 38 is set in accordance with the size of the largest printing plate 12 (e.g., 1160 mm by 940 mm). When about 100 of the largest printing plates are accommodated, the size of the cassette 38 is set to about, for example, a height of 70 mm, a width of 1300 mm, and a length of 1070 mm.

A rectangular opening 150 is formed in the top end of the cassette stocker portion 19 so as to extend substantially entirely thereover. The size (surface area) of the opening 150 is greater than the size of the largest printing plate 12 (e.g., 1160 mm by 940 mm). The largest printing plate 12 passes through the opening 150 by being moved in the direction orthogonal to the plate surface direction (i.e., in the direction of thickness). For example, when the width by length dimensions of the cassette stocker portion 19 are set to 1500 mm by 1200 mm, the width by length dimensions of the opening are set to about 1300 mm by 1070 mm.

A loading space 152, at which one cassette 38 can be accommodated, is provided directly beneath the opening 150 (i.e., above the topmost cassette 38).

Note that the height of the cassette stocker portion 19 is set to be low (e.g., 800 mm or less). For example, in a case in which there are five cassettes 38 and the height of the space in which each cassette 38 is accommodated is 100 mm and the height of the loading space portion 152 is 100 mm, the height of the cassette stocker portion 19 is set to be 800 mm or less. Therefore, the height of the top portion of the cassette stocker portion 19 (the opening 150) is a height which is appropriate for the work of loading the printing plates 12, and the workability at the time of loading the printing plates 12 is improved.

Here, due to the operation of the feed screws 25, the raising/lowering stand 23 can move to a position corresponding to the loading space 152. The cassette 38 placed on the raising/lowering stand 23 can be moved to (positioned at) the loading space 152. When one of the cassettes 38 among the plurality of cassettes 38 is empty (i.e., when refilling of the printing plates 12 therein is required), that cassette 38 is placed on the raising/lowering stand 23, and is moved to the loading space 152.

Above the loading space 152, a substantially rectangular flat-plate-shaped sliding cover 154 serving as a cover member is disposed at the opening 150 so as to be parallel to the top edge of the cassette stocker portion 19 (i.e., parallel to the floor). The sliding cover 154 is supported by unillustrated rails which are provided at the side walls of the cassette stocker portion 19 and the removing portion 17. Due to the sliding cover 154 moving horizontally (in the direction of arrow G in FIG. 2 and the direction of arrow H in FIG. 2) along these rails, the sliding cover 154 can open and close the opening 150 of the cassette stocker portion 19.

The sliding cover 154 is disposed at a position which is lower than the base points 70 of the removing/conveying mechanism 50. When the sliding cover 154 is moved toward the removing portion 17, the suction cups 40 are rotated 180° from the "removing position", and are disposed above the base points 70. In this way, the sliding cover 154, which has been moved toward the removing portion 17, is disposed between the removing/conveying mechanism 50 and the cassette moving mechanism (the raising/lowering stand 23 and the feed screws 25).

A jagged portion 156 is formed at one edge of the sliding cover 154 (the edge toward the front in the direction orthogonal to the surface of the drawing of FIG. 2). A spur gear 158, which is provided above one end portion of the sliding cover 154 (the left end portion in FIG. 2), engages with the jagged portion 156. The jagged portion 156 is formed so as to correspond to the teeth of the spur gear 158. The spur gear 158 can rotate relative to the removing portion 17 due to a supporting shaft 160, which is fit into the center of the spur gear 158, being rotatably supported at the removing portion 17 (although this structure is not illustrated).

A motor 162 serving as a drive source is provided above the spur gear 158. A rotating shaft 164 of the motor 162 is rotated clockwise (in the direction of arrow CW in FIG. 2) and counterclockwise (in the direction of arrow CCW in FIG. 2) by an unillustrated control circuit provided at the automatic printing plate exposing device 10, via an unillustrated wire provided at the automatic printing plate exposing device 10. A belt 166, which is a power transmitting device, is trained around the rotating shaft 164 of the motor 162 and the supporting shaft 160 of the spur gear 158.

When the rotating shaft 164 of the motor 162 is rotated by the control circuit clockwise in FIG. 2 (in the direction of arrow CW in FIG. 2), the spur gear 158 is rotated clockwise in FIG. 2 (in the direction of arrow CW in FIG. 2) via the belt 166. Therefore, the sliding cover 154, with whose jagged portion 156 the spur gear 158 is engaged, is moved toward the removing portion 17 (see arrow G in FIG. 2), and the opening 150 of the cassette stocker portion 19 is opened.

When the rotating shaft 164 of the motor 162 is rotated by the control circuit counterclockwise in FIG. 2 (in the direction of arrow CCW in FIG. 2), the spur gear 158 is rotated counterclockwise in FIG. 2 (in the direction of arrow CCW in FIG. 2) via the belt 166. Therefore, the sliding cover 154, with whose jagged portion 156 the spur gear 158 is engaged, is moved toward the cassette stocker portion 19 (see arrow H in FIG. 2), and the opening 150 of the cassette stocker portion 19 is closed by the sliding cover 154 (the state shown in FIG. 2).

Next, operation of the present first embodiment will be described.

At the automatic printing plate exposing device 10 having the above-described structure, when the printing plate 12 (and the interleaf sheet 13) are to be taken out from the cassette 38, one of the cassettes 38, which are placed one above the other in plural levels, is specified.

When the cassette 38 is selected (specified), the raising/lowering stand 23 is moved vertically by operation of the feed screws 25, and is made to stand-by at a position corresponding to the selected one cassette 38. That selected one cassette 38 is, independently of the other cassettes 38, pulled-out in the horizontal direction toward the removing portion 17, and is placed on the raising/lowering stand 23. Then, that cassette 38 (the raising/lowering stand 23) is moved vertically to the "removing position", the removing/conveying mechanism 50 is operated, the respective suction cups 40 are moved to the "removing position", and the printing plate 12 within that cassette 38 is sucked by the suction cups 40.

After the sucking by the suction cups 40, that cassette 38 is, together with the raising/lowering stand 23, lowered by the feed screws 25, and is withdrawn to a predetermined withdrawn position beneath. Accompanying this lowering of the cassette 38, the suction cups 40 suck and lift-up the printing plate 12 together with the uppermost interleaf sheet 13.

In this case, when the sucked interleaf sheet 13 and printing plate 12 move away from the cassette 38, the interleaf sheet 13 or printing plate 12 therebeneath may stick to the sucked printing plate 12 due to static electricity or sticking caused by a vacuum between the plates themselves. At this time, due to the separating by the separating plate (not illustrated) provided at the cassette 38, only the uppermost interleaf sheet 13 which is receiving the suction force and the printing plate 12 immediately therebeneath are separated from the other interleaf sheets 13 and printing plates 12 therebeneath, and are removed.

After the suction cups 40 of the sucking/conveying mechanism 50 have lifted the printing plate 12 (and the interleaf sheet 13) up out of the cassette 38, the suction cups 40 move horizontally in the direction of the exposure section 14 while being rotated 180° around the base points 70, and transfer the printing plate 12 (and the interleaf sheet 13) to the conveying rollers 108.

After this sucking, separating, and removing by the suction cups 40, that cassette 38 (the raising/lowering stand 23) is raised again to the "removing position" so as to be set in a prepared state. Thereafter, the above-described operations are repeated such that the printing plates 12 are successively sucked and removed from the cassette 38.

The printing plate 12 (and the interleaf sheet 13) which have been transferred to the conveying rollers 108 are conveyed toward the exposure section 14 by the conveying rollers 108. The interleaf sheet 13 is peeled off from the printing plate 12 by the roller 74B which rotates in the direction opposite to the conveying direction. The peeled-off interleaf sheet 13 is pulled-in between the rollers 74, is fed to the lower rollers 76, and is discarded in an unillustrated discard box.

The printing plate 12 continues to be conveyed substantially horizontally along the guide plate 109, and is fed to the plate supplying guide 20. The printing plate 12 on the plate supplying guide 20 is fed to the rotating drum 16. The leading end portion of the printing plate 12 is held by the leading end chucks 26. Due to the rotating drum 16 rotating in this state, the printing plate 12 is tightly trained around the peripheral surface of the rotating drum 16. Thereafter, due to the trailing end of the printing plate 12 being held by the trailing end chucks 36, preparations for exposure are completed.

In this state, image data is read, and exposure processing by the light beam from the recording head portion 37 is started. The exposure processing is so-called scan exposure in which the recording head portion 37 moves in the axial direction of the rotating drum 16 while the rotating drum 16 is rotated at high speed (main scanning).

When the exposure processing is completed, the conveying guide unit 18 is switched (the plate discharging guide 22 is made to correspond to the rotating drum 16). Then, the printing plate 12 trained around the rotating drum 16 is discharged out from a direction tangent to the rotating drum 16. At this time, the printing plate 12 is fed to the plate discharging guide 22. When the printing plate 12 is fed to the plate discharging guide 22, the conveying guide unit 18 is switched such that the plate discharging guide 22 is made to correspond to the discharge opening, and the printing plate 12 is discharged out. The developing section is provided in the direction of discharging, and the printing plate 12 is subsequently subjected to developing processing.

At the removing/conveying section 15 (the printing plate removing/supplying device) relating to the present embodiment, in the state in which the removing and conveying of the printing plate 12 toward the exposure section 14 is being carried out, the sliding cover 154 is moved to (is positioned at) the cassette stocker portion 19, and the opening 150 of the cassette stocker portion 19 is closed by the sliding cover 154 (the state shown in FIG. 1).

Here, in a case in which one of the cassettes 38 among the plurality of cassettes 38 is empty, first, the suction cups 40 are rotated 180° from the "removing position" so as to be disposed above the base points 70, and the empty cassette 38 is placed on the raising/lowering stand 23 and moved to the loading space 152. Then, due to the rotating shaft 164 of the motor 162 being rotated clockwise (in the direction of arrow CW in FIG. 2) by the control circuit provided at the automatic printing plate exposing device 10, the spur gear 158 is rotated clockwise (in the direction of arrow CW in FIG. 2) via the belt 166. Therefore, due to the sliding cover 154, whose jagged portion 156 is engaged by the spur gear 158, being moved toward the removing portion 17 (in the direction of arrow G in FIG. 2), the opening 150 of the cassette stocker portion 19 is opened. The empty cassette 38, which has been moved to (positioned at) the loading space 152, is exposed.

In this way, the printing plates 12 can be loaded (refilled) into the empty cassette 38 positioned at the loading space 152, from above the cassette stocker portion 19 (i.e., from the opening 150).

Accordingly, as compared with a structure in which loading of the printing plates 12 is carried out by pulling the cassette 38 out horizontally from the cassette stocker portion, there is no need to ensure space for pulling-out of the cassette 38. Therefore, ultimately, the space needed for placement of the automatic printing plate exposing device 10 can be reduced.

Moreover, there is no need for members (side surface covers, members for supporting the side surface covers, and the like) for supporting the cassette 38 in the state in which the cassette 38 is pulled out. Therefore, the cost of the cassette stocker portion 19 can be reduced.

In addition, because the printing plates 12 can be loaded into the plural cassettes 38 at the same operational posture (at the same position), the workability at the time of loading the printing plates 12 is improved.

When the operation for loading (refilling) the printing plates 12 into the cassette 38 is completed, after safety has been confirmed, the rotating shaft 164 of the motor 162 is rotated counterclockwise (in the direction of arrow CCW in FIG. 2) by the control circuit provided at the automatic printing plate exposing device 10. The spur gear 158 is thereby rotated counterclockwise (in the direction of arrow CCW in FIG. 2) via the belt 166. Therefore, due to the sliding cover 154, whose jagged portion 156 is engaging with the spur gear 158, moving toward the cassette stocker portion 19 (in the direction of arrow H in FIG. 2), the opening 150 of the cassette stocker portion 19 is closed by the sliding cover 154. Next, the cassette 38 in the loading space 152 is placed on the raising/lowering stand 23, and is again moved to a predetermined position by the raising/lowering stand 23 and the feed screws 25.

In this way, in the removing/conveying section 15 (the printing plate removing/supplying device) relating to the present first embodiment, it is possible to reduce the space required for placement of the device, reduce the cost of the device, and improve the workability at the time of loading the printing plates 12.

Moreover, because the structure of the sliding cover 154 which is the cover member is simple, the number of parts is reduced and the cost is reduced. Moreover, adjustment during assembly is easy.

In addition, because the sliding cover 154 is structured so as to move horizontally, the load applied to the motor 162 which is the driving source is small and constant. In this way, it is possible to make the motor 162 compact, and to decrease costs.

Because the sliding cover 154 is flat-plate-shaped and is easily reinforced, it can be formed by a thin plate, and costs can be decreased.

(Second Embodiment)

Next, a second embodiment will be described. Structures and operations which are basically the same as those of the above-described first embodiment are denoted by the same reference numerals as in the first embodiment, and description thereof is omitted.

Figure 3:
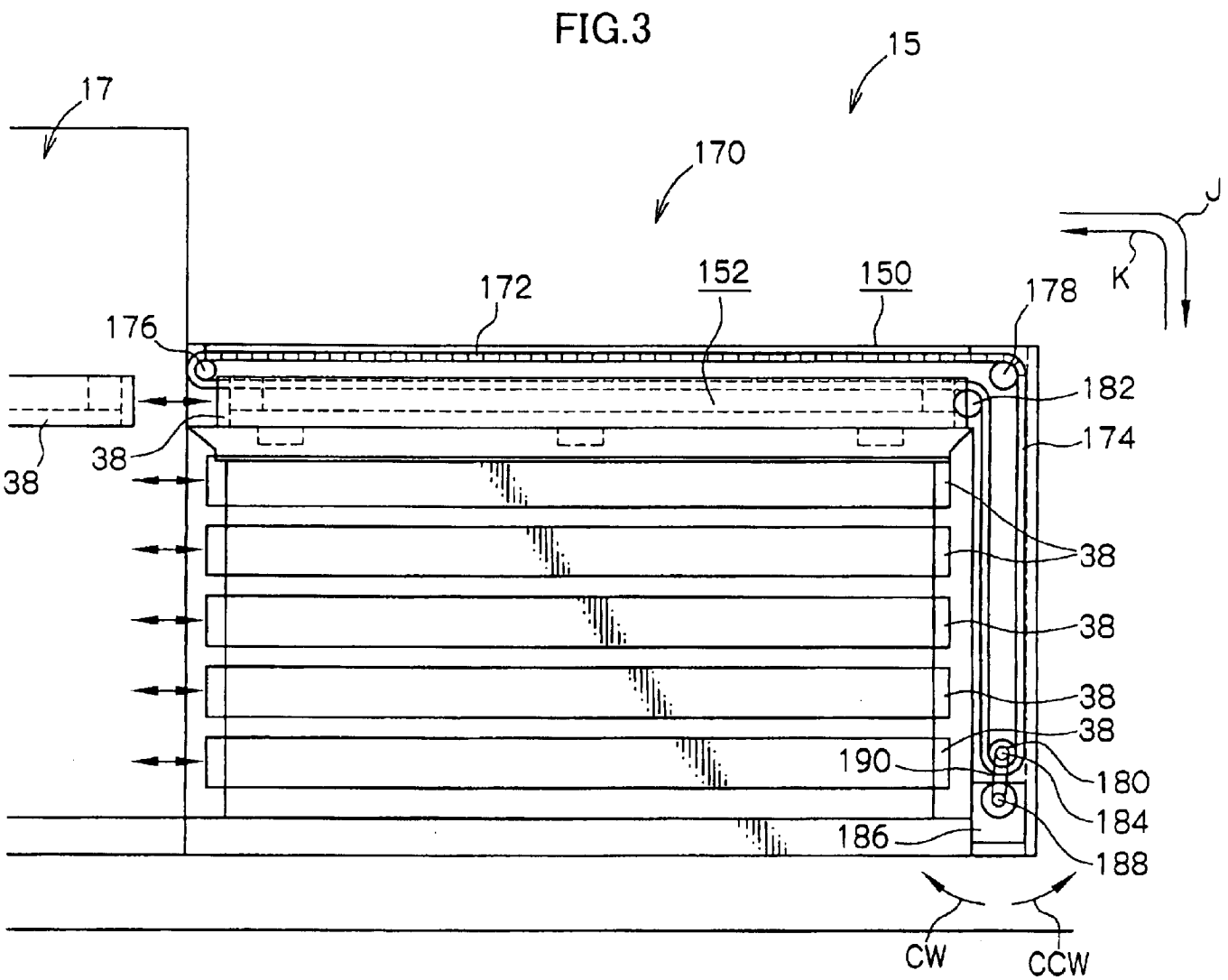
FIG. 3 is a side view showing a cassette stocker portion which is a structural member of a printing plate removing/supplying device relating to a second embodiment of the present invention.

The structure of a cassette stocker portion 170 serving as an accommodating portion relating to the second embodiment of the present invention is shown in side view in FIG. 3.

The cassette stocker portion 170 basically has the same structure as that of the cassette stocker portion 19 relating to the above-described first embodiment. However, at the cassette stocker portion 170, the cover member is a shutter 172 which is flexible.

The end portions of the shutter 172 in the transverse direction thereof (the direction orthogonal to the surface of the drawing of FIG. 3) are fixed to two chains 174 which are provided at the end portions of the cassette stocker portion 170 in the transverse direction thereof (the direction orthogonal to the surface of the drawing of FIG. 3). Each of the chains 174 is trained around four sprockets which will be described later and which are rotatably supported, at the inner walls at both sides in the transverse direction of the cassette stocker portion 170.

Here, sprockets 176 are rotatably supported at both sides in the transverse direction of the cassette stocker portion 170, at the removing portion 17 side end portion of the top end portion of the cassette stocker portion 170. The chains 174 are trained around these sprockets 176. At the side of the top end portion of the cassette stocker portion 170 opposite the removing portion 17 side thereof, the chains 174 are trained around sprockets 178 which are rotatably supported at the inner walls at both transverse direction sides of the cassette stocker portion 170. Sprockets 180 are rotatably supported beneath the sprockets 178 at the inner walls at both transverse direction sides of the cassette stocker portion 170. The chains 174 are trained around the lower sprockets 180 and sprockets 182 so as to form substantially L-shaped loops on the whole.

The sprockets 180 are connected together by a shaft 184. A motor 186 serving as a drive source is provided beneath one of the sprockets 180 (the sprocket 180 which is illustrated in FIG. 3). The motor 186 is fixed to the floor wall of the cassette stocker portion 170. A rotating shaft 188 of the motor 186 is rotated clockwise (in the direction of arrow CW in FIG. 3) and counterclockwise (in the direction of arrow CCW in FIG. 3) by an unillustrated control circuit provided at the automatic printing plate exposing device 10 and via an unillustrated wire provided at the automatic printing plate exposing device 10. A belt 190 is trained about the rotating shaft 188 of the motor 186 and the aforementioned one sprocket 180.

Here, in the state in which the opening 150 is closed by the shutter 172 (i.e., in the state shown in FIG. 3), when the rotating shaft 188 of the motor 186 is rotated clockwise in FIG. 3 (in the direction of arrow CW in FIG. 3) by the control circuit, the sprockets 180 are rotated clockwise in FIG. 3 (in the direction of arrow CW in FIG. 3) via the belt 190. Therefore, the chains 174 trained around the sprockets 180 are rotated clockwise in FIG. 3 while being supported by the respective sprockets (the sprockets 176, 178, 180, 182). Therefore, the shutter 172 which is fixed to the chains 174 is moved in the direction of arrow J in FIG. 3, and is accommodated between the cassettes 38 which are disposed one above the other in plural levels, and the side wall of the cassette stocker portion 170 opposite the removing portion 17 side thereof (i.e., the shutter 172 is taken-up by the sprockets 178, 180, 182). In this way, the opening 150 of the cassette stocker portion 170 is opened.

In the state in which the opening 150 of the cassette stocker portion 170 is open, when the rotating shaft 188 of the motor 186 is rotated counterclockwise in FIG. 3 (in the direction of arrow CCW in FIG. 3) by the control circuit, the sprockets 180 are rotated counterclockwise in FIG. 3 (in the direction of arrow CCW in FIG. 3) via the belt 190. Therefore, the chains 174 trained around the sprockets 180 are rotated counterclockwise in FIG. 3 while being supported by the respective sprockets (the sprockets 176, 178, 180, 182). Therefore, the shutter 172 which is fixed to the chains 174 is moved in the direction of arrow K in FIG. 3, and is positioned at the opening 150 (the state shown in FIG. 3). In this way, the opening 150 of the cassette stocker portion 170 is again closed by the shutter 172.

Next, operation of the cassette stocker portion 170 relating to the second embodiment of the present invention will be described.

In the cassette stocker portion 170 relating to the present second embodiment, in the state in which the removing and conveying of the printing plate 12 to the exposure section 14 is being carried out, the opening 150 is in a state of being closed by the shutter 172 (the state shown in FIG. 3).

Here, when one of the cassettes 38 among the plurality of cassettes 38 is empty, that empty cassette is disposed on the raising/lowering stand 23, and is moved to the loading space 152. Due to the sprockets 180 being rotated clockwise in FIG. 3 by the motor 186, the chains 174 trained around the sprockets 180 are rotated clockwise in FIG. 3 while being supported by the respective sprockets (the sprockets 176, 178, 180, 182). Therefore, the shutter 172 which is fixed to the chains 174 is moved in the direction of arrow J in FIG. 3, and is accommodated between the cassettes 38 which are disposed one above the other in plural levels, and the side wall of the cassette stocker portion 170 opposite the removing portion 17 side thereof. In this way, the opening 150 of the cassette stocker portion 170 is opened.

In this way, the printing plates 12 can be loaded (refilled) into the empty cassette 38 positioned at the loading space 152, from above the cassette stocker portion 170 (i.e., from the opening 150).

Moreover, there is no need for members (side surface covers, members for supporting the side surface covers, and the like) for supporting the cassette 38 in the state in which the cassette 38 is pulled out. Therefore, the cost of the cassette stocker portion 170 can be reduced.

In addition, because the printing plates 12 can be loaded into the plural cassettes 38 at the same operational posture (at the same position), the workability at the time of loading the printing plates 12 is improved.

When the operation for loading (refilling) the printing plates 12 into the cassette 38 is completed, after safety has been confirmed, the sprockets 180 are rotated counterclockwise in FIG. 3 by the motor 186. Therefore, the chains 174 which are trained around the sprockets 180 are rotated counterclockwise in FIG. 3 while being supported by the respective sprockets (the sprockets 176, 178, 180, 182). In this way, the shutter 172 supported at the respective chains 174 is moved toward the opening 150, and the opening 150 is again closed by the shutter 172.

In this way, in the removing/conveying section 15 (the printing plate removing/supplying device) relating to the present second embodiment, it is possible to reduce the space required for placement of the device, reduce the cost of the device, and improve the workability at the time of loading the printing plates 12.

Moreover, the shutter 172 which is the cover member is accommodated (taken-up) within the cassette stocker portion 170. Therefore, the shutter 172 can be opened and closed within the range of the surface area occupied by the cassette stocker portion 170, and the space needed for the device can be reduced.

In addition, there is no need to withdraw the suction cups 40 to above the base points 70 at the time of loading the printing plates 12 into the empty cassette 38. Therefore, the supplying and conveying of the printing plates 12 to the exposure section 14 can be carried out from the printing plates 12 accommodated in another of the cassettes 38.

(Third Embodiment)

Next, a third embodiment will be described. Structures and operations which are basically the same as those of the above-described first embodiment are denoted by the same reference numerals as in the first embodiment, and description thereof is omitted.

Figure 4:
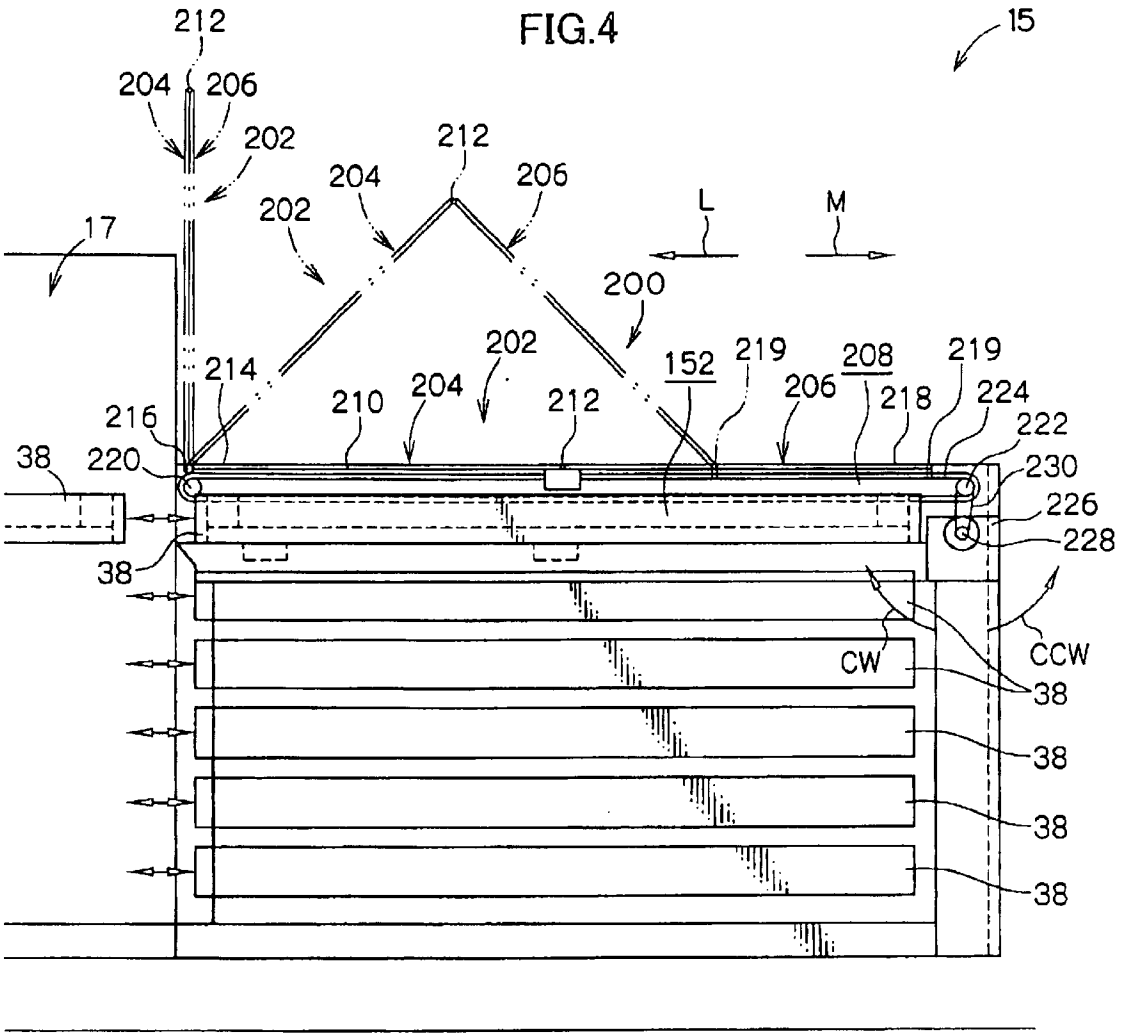
FIG. 4 is a side view showing a cassette stocker portion which is a structural member of a printing plate removing/supplying device relating to a third embodiment of the present invention.

The structure of a cassette stocker portion 200 serving as an accommodating portion relating to the third embodiment of the present invention is shown in side view in FIG. 4.

The cassette stocker portion 200 basically has the same structure as that of the cassette stocker portion 19 relating to the above-described first embodiment. However, in the present third embodiment, the cover member is a folding cover 202 which can be folded over.

The folding cover 202 has a plate member 204 and a plate member 206, each of which is shaped as a rectangular, flat plate, and which are formed in the same configurations and to the same dimensions. The plate member 204 and the plate member 206 are both disposed in a state in which their both transverse direction end portions (the both end portions in the direction orthogonal to the surface of the drawing of FIG. 4) are supported at a step 210 which is formed at an opening 208 of the cassette stocker portion 200. The opening 208 is closed by the plate member 204 and the plate member 206. The end portions of plate member 204 and the plate member 206, which end portions oppose one another, are connected by a hinge 212. The folding cover 202 is structured so as to be able to be folded over via the hinge 212.

A shaft 216 is fixed to an end portion 214 of the plate member 204 (the end portion at the removing portion 17 side in FIG. 4). Due to the shaft 216 being rotatably supported at the opening 208 (the top end portion) of the cassette stocker portion 200, the plate member 204 can rotate around the shaft 216 with respect to the cassette stocker portion 200.

An end portion 218 of the plate member 206 (the end portion at the side opposite the removing portion 17 side in FIG. 4) is supported so as to be able to move along the step 210 formed at the opening 208.

A sprocket 220 and a sprocket 222, each of which is supported rotatably, are provided at the removing portion 17 side end portion and the end portion opposite the removing portion 17 side, beneath the folding cover 202 at the cassette stocker portion 200. A chain 224 is trained around the sprocket 220 and the sprocket 222. A connecting member 219 is provided between the folding cover 202 side portion of the chain 224 (the upper side portion of the chain 224 in FIG. 4) and the end portion 218 of the plate member 206. The end portion 218 of the plate member 206 and the chain 224 are rotatably connected by this connecting member 219.

Although not illustrated, the sprocket 220, the sprocket 222, the chain 224, and the connecting member 219 are provided at each of the end portions in the transverse direction (the direction orthogonal to the surface of the drawing of FIG. 4) of the cassette stocker portion 200. The sprockets 222 are connected by an unillustrated shaft.

A motor 226 serving as a drive source is disposed beneath the sprocket 222. A rotating shaft 228 of the motor 226 is rotated clockwise (in the direction of arrow CW in FIG. 4) and counterclockwise (in the direction of arrow CCW in FIG. 4) by an unillustrated control circuit provided at the automatic printing plate exposing device 10 and via an unillustrated wire provided at the automatic printing plate exposing device 10. Further, a belt 230 is trained around the rotating shaft 228 of the motor 226 and one of the sprockets 222 (the sprocket 222 shown in FIG. 4).

Here, when the rotating shaft 228 of the motor 226 is rotated counterclockwise in FIG. 4 (in the direction of arrow CCW in FIG. 4) by the control circuit, the sprockets 222 are rotated counterclockwise in FIG. 4 (in the direction of arrow CCW in FIG. 4) via the belt 230. Therefore, the folding cover 202 side portions of the chains 224 which are trained between the sprockets 222 and the sprockets 220 (i.e., the upper side portions of the chains 224 in FIG. 4) are moved toward the removing portion 17 (in the direction of arrow L in FIG. 4). The end portion 218 of the plate member 206 connected to the folding cover 202 sides of the chains 224 by the connecting members 219 is moved toward the removing portion 17 (in the direction of arrow L in FIG. 4). Therefore, the folding cover 202 is folded over via the hinge 212 (is set in the inverted V shape shown by the two-dot chain line in FIG. 4), and the end portion 218 of the plate member 206 approaches the end portion 214 of the plate member 204. When the end portion 214 of the plate member 204 and the end portion 218 of the plate member 206 have moved so as to abut one another, the folding cover 202 is folded-over via the hinge 212 in a state in which the plate members 204, 206 are superposed together in the direction of plate thickness thereof. At this time, at the removing portion 17 side end portion of the cassette stocker portion 200, the folding cover 202 is in a state of projecting vertically upward with respect to the cassette stocker portion 200, and the opening 208 of the cassette stocker portion 200 is opened.

In this state in which the opening 208 of the cassette stocker portion 200 has been opened, when the rotating shaft 228 of the motor 226 is rotated clockwise in FIG. 4 (in the direction of arrow CW in FIG. 4) by the control circuit, the sprockets 222 are rotated clockwise in FIG. 4 (in the direction of arrow CW in FIG. 4) via the belt 230. Therefore, the folding cover 202 side portions of the chains 224 which are trained around the sprockets 222 and the sprockets 220 (i.e., the upper side portions of the chains 224 in FIG. 4) are moved toward the side opposite the removing portion 17 (i.e., in the direction of arrow M in FIG. 4). The end portion 218 of the plate member 206, which is connected by the connecting members 219 to the folding cover 202 sides of the chains 224, is moved toward the side opposite the removing portion 17 (i.e., in the direction of arrow M in FIG. 4). Therefore, the plate member 204 and the plate member 206 of the folding cover 202, which is folded over via the hinge 212, move apart from one another. Then, the plate member 204 and the plate member 206 are supported at the step 210 of the cassette stocker portion 200 and are moved to positions of being lined up horizontally (the state shown in FIG. 4). In this way, the opening 208 of the cassette stocker portion 200 is again closed by the folding cover 202.

Next, operation of the cassette stocker portion 200 relating to the third embodiment of the present invention will be described.

In the cassette stocker portion 200 relating to the present third embodiment, in the state in which the removing and conveying of the printing plate 12 to the exposure section 14 is being carried out, the opening 208 of the cassette stocker portion 200 is in a state of being closed by the folding cover 202 (the state shown in FIG. 4).

Here, when one of the cassettes 38 among the plurality of cassettes 38 is empty, that empty cassette 38 is disposed on the raising/lowering stand 23, and is moved to the loading space 152. The sprockets 222 are rotated counterclockwise in FIG. 4 (in the direction of arrow CCW in FIG. 4) by the motor 226. Therefore, the folding cover 202 side portions of the chains 224 (i.e., the upper side portions of the chains 224 in FIG. 4) are moved toward the removing portion 17 (in the direction of arrow L in FIG. 4), and the end portion 218 of the plate member 206 connected to the chains 224 is moved toward the removing portion 17 (in the direction of arrow L in FIG. 4). In this way, at the removing portion 17 side end portion of the cassette stocker portion 200, the folding cover 202 is folded over in a state of projecting vertically upward with respect to the cassette stocker portion 200, and the opening 208 of the cassette stocker portion 200 is opened.

Accordingly, the printing plates 12 can be loaded (refilled) into the empty cassette 38 positioned at the loading space 152, from above the cassette stocker portion 200 (i.e., from the opening 208).

Moreover, there is no need for members (side surface covers, members for supporting the side surface covers, and the like) for supporting the cassette 38 in the state in which the cassette 38 is pulled out. Therefore, the cost of the cassette stocker portion 200 can be reduced.

In addition, because the printing plates 12 can be loaded into the plural cassettes 38 at the same operational posture (at the same position), the workability at the time of loading the printing plates 12 is improved.

When the operation for loading (refilling) the printing plates 12 into the cassette 38 is completed, after safety has been confirmed, the sprockets 222 are rotated clockwise in FIG. 4 (in the direction of arrow CW in FIG. 4) by the motor 226. Therefore, the folding cover 202 side portions of the chains 224 (i.e., the upper side portions of the chains 224 in FIG. 4) are moved toward the side opposite the removing portion 17 (in the direction of arrow M in FIG. 4), and the end portion 218 of the plate member 206 connected to the chains 224 is moved toward the side opposite the removing portion 17 (in the direction of arrow M in FIG. 4). In this way, the plate member 204 and the plate member 206 of the folding cover 202 are supported at the step 210 of the cassette stocker portion 200, and are moved to positions of being lined up horizontally, and the opening 208 is again closed by the folding cover 202.

In this way, in the removing/conveying section 15 (the printing plate removing/supplying device) relating to the present third embodiment, it is possible to reduce the space required for placement of the device, reduce the cost of the device, and improve the workability at the time of loading the printing plates 12.

Moreover, the opening 208 of the cassette stocker portion 200 is open in a state in which the folding cover 202 projects vertically upward with respect to the cassette stocker portion 200 at the removing portion side end portion of the cassette stocker portion 200. Therefore, the folding cover 202 can be opened and closed within the range of the surface area occupied by the cassette stocker portion 200, and less space is required.

The plate member 204 and the plate member 206, which are the structural members of the folding cover 202, are flat-plate-shaped and are easily reinforced. Therefore, they can be formed by thin plates. As a result, costs can be reduced.

As described above, in accordance with the printing plate removing/supplying device of the present invention, less space is needed for placement of the device, the cost of the device is reduced, and the workability at the time of loading printing plates is improved.

What is claimed is:

1. A printing plate removing/supplying device comprising:

an accommodating portion at whose top end an opening is formed, and which accommodates, stacked in plural levels in a state of being provided at predetermined intervals, cassettes in which plural printing plates are loaded in from an upper side and stacked, the accommodating portion having a loading space which is directly beneath the opening and at which one of the cassettes can be accommodated, and the printing plates can be loaded from the opening into the cassette which is positioned at the loading space;

a cover member provided at the opening of the accommodating portion and able to open and close the opening;

a removing portion provided adjacent to the accommodating portion, a printing plate removing position being set at the removing portion;

a cassette moving mechanism which is provided at the removing portion, and which, independently of other cassettes, pulls one cassette selected from among the plural cassettes out to the removing portion and moves the selected one cassette to the removing position, and which is able to move the selected one cassette to the loading space as well; and a removing/conveying mechanism provided at the removing portion, and removing the printing plate from the cassette positioned at the removing position, and able to convey and supply the printing plate to a portion-to-be-supplied-to of a subsequent process.

2. The printing plate removing/supplying device of claim 1, wherein the cover member is movable so as to open and close the opening, within a range of an interior of the accommodating portion and an interior of the removing portion.

3. The printing plate removing/supplying device of claim 1, wherein the cassette moving mechanism comprises a raising/lowering stand, and feed screws supporting the raising/lowering stand and able to move the raising/lowering stand up and down.

4. The printing plate removing/supplying device of claim 3, wherein the removing/conveying mechanism comprises a plurality of suction cups disposed along a transverse direction of the printing plates, and base points supporting the suction cups such that the suction cups are suspended downward, and the suction cups can move to the removing position as the base points move.

5. The printing plate removing/supplying device of claim 4, wherein the base points can move horizontally along the cassette which is on the raising/lowering stand and can rotate, and after the suction cups have sucked the printing plate, the suction cups, together with the base points, can convey the printing plate while inverting the printing plate by rotating 180° while moving horizontally.

6. The printing plate removing/supplying device of claim 4, wherein the cover member is disposed at a position which is lower than the base points of the removing/conveying mechanism.

7. The printing plate removing/supplying device of claim 6, wherein, when the cover member is moved toward the removing portion, the suction cups are rotated 180° from the removing position and disposed above the base points, and the cover member can be disposed between the removing/conveying mechanism and the cassette moving mechanism.

8. The printing plate removing/supplying device of claim 1, wherein the removing position is a position in an up/down direction of the printing plates.

9. The printing plate removing/supplying device of claim 1, wherein the cover member is a sliding cover which is provided parallel to an upper edge of the accommodating portion, and which can slide horizontally, and which is rectangular and flat-plate-shaped.

10. The printing plate removing/supplying device of claim 1, wherein convex and concave portions are formed at one edge of the cover member, and a spur gear, which is provided at an upper side of the one edge of the cover member and which can rotate relative to the removing portion, can engage with the convex and concave portions.

11. The printing plate removing/supplying device of claim 10, further comprising a drive source connected so as to be able to transfer power to a supporting shaft of the spur gear.

12. The printing plate removing/supplying device of claim 11, wherein, when the drive source is operated and the spur gear rotates, the cover member, which is engaged with the spur gear via the convex and concave portions, moves toward the removing portion, and is thereby able to open the opening of the accommodating portion.

13. The printing plate removing/supplying device of claim 11, further comprises sprockets which are connected together by a shaft and the drive source is provided beneath one of the sprockets.

14. The printing plate removing/supplying device of claim 1, wherein the cover member is a flexible shutter.

15. The printing plate removing/supplying device of claim 14, wherein at least two chains are provided at transverse direction end portions of the accommodating portion, and both transverse direction end portions of the shutter are fixed to the chains.

16. The printing plate removing/supplying device of claim 15, wherein each of the chains is trained around four sprockets which are rotatably supported at a transverse direction side inner wall of the accommodating portion.

17. The printing plate removing/supplying device of claim 1, wherein the cover member is a folding cover which can be folded over.

18. The printing plate removing/supplying device of claim 17, wherein the folding cover comprises a first plate member and a second plate member having same configurations and same dimensions, and the first and second plate members are both disposed in a state in which both transverse direction end portions thereof are supported at a step formed at the opening of the accommodating portion, and the opening can be closed by the first and second plate members, and end portions of the first and second plate members which end portions oppose one another are connected by a hinge, and the folding cover can be folded over via the hinge.

19. The printing plate removing/supplying device of claim 18, wherein a shaft is fixed to one end portion of the first plate member, and due to the shaft being rotatably supported at the opening of the accommodating portion, the first plate member can rotate around the shaft with respect to the accommodating portion.

20. The printing plate removing/supplying device of claim 18, wherein one end portion of the second plate member is supported so as to be movable along the step formed at the opening.

* * * * *